US005287803A

United States Patent [19]

Cole

[11] Patent Number: 5,287,803

[45] Date of Patent: Feb. 22, 1994

[54] CAN CRUSHING APPARATUS

[76] Inventor: Joseph L. Cole, P.O. Box 1494, Pittsburg, Calif. 94565

[21] Appl. No.: 31,705

[22] Filed: Mar. 15, 1993

[51] Int. Cl.[5] ..... B30B 15/30; B30B 9/32

[52] U.S. Cl. ..... 100/45; 100/73; 100/215; 100/218; 100/902

[58] Field of Search ..... 100/45, 49, 70 R, 73, 100/74, 215, 218, 902

[56] References Cited

U.S. PATENT DOCUMENTS

| | | | |
|---|---|---|---|
| 969,720 | 9/1910 | Pickett | 100/215 |
| 2,221,806 | 11/1940 | Loomis | 100/73 X |
| 2,984,172 | 5/1961 | Roberts et al. | 100/218 X |
| 3,835,768 | 9/1974 | Kidson | 100/902 X |
| 4,007,677 | 2/1977 | Fox | 100/45 |
| 4,102,259 | 7/1978 | Thompson et al. | 100/49 X |
| 4,102,263 | 7/1978 | Forsberg | 100/74 |
| 4,103,609 | 8/1978 | Hiatt | 100/902 X |
| 4,235,164 | 11/1980 | Allen et al. | 100/902 X |
| 4,326,457 | 4/1982 | Sather | 100/902 X |
| 4,459,906 | 7/1984 | Cound et al. | 100/45 |
| 4,463,670 | 8/1984 | Thomas | 100/902 X |
| 4,483,246 | 11/1984 | Sullivan et al. | 100/45 X |
| 4,599,941 | 7/1986 | Johnson et al. | 100/902 X |
| 4,953,682 | 9/1990 | Helbawi | 100/902 X |
| 4,962,701 | 10/1990 | Stralow | 100/902 X |
| 4,976,196 | 12/1990 | Phillips et al. | 100/902 X |
| 5,009,155 | 4/1991 | Christianson | 100/902 X |
| 5,010,810 | 4/1991 | DeLorme | 100/902 X |
| 5,090,308 | 2/1992 | Wang | 100/215 |

FOREIGN PATENT DOCUMENTS

| | | | |
|---|---|---|---|
| 645161 | 5/1937 | Fed. Rep. of Germany | 100/215 |
| 1392203 | 2/1965 | France | 100/902 |
| 2536011 | 5/1984 | France | 100/73 |
| 56-20000 | 2/1981 | Japan | 100/218 |
| 57-142797 | 9/1982 | Japan | 100/902 |
| 81/02802 | 10/1981 | PCT Int'l Appl. | 100/902 |

*Primary Examiner*—Stephen F. Gerrity
*Attorney, Agent, or Firm*—Leon Gilden

[57] ABSTRACT

A cylindrical housing includes a piston displaceable therewithin, wherein the piston includes a piston plate mounted to an opposed end of a piston rod, wherein the piston plate is in operative communication and directed through a guide tube having a tube floor to effect crushing of an associated can member directed between the piston plate and the guide tube floor. Feet structure is arranged to intersect the guide tube between the piston plate and the guide tube floor to properly position a can member to effect crushing thereof.

5 Claims, 4 Drawing Sheets

Fig. 7
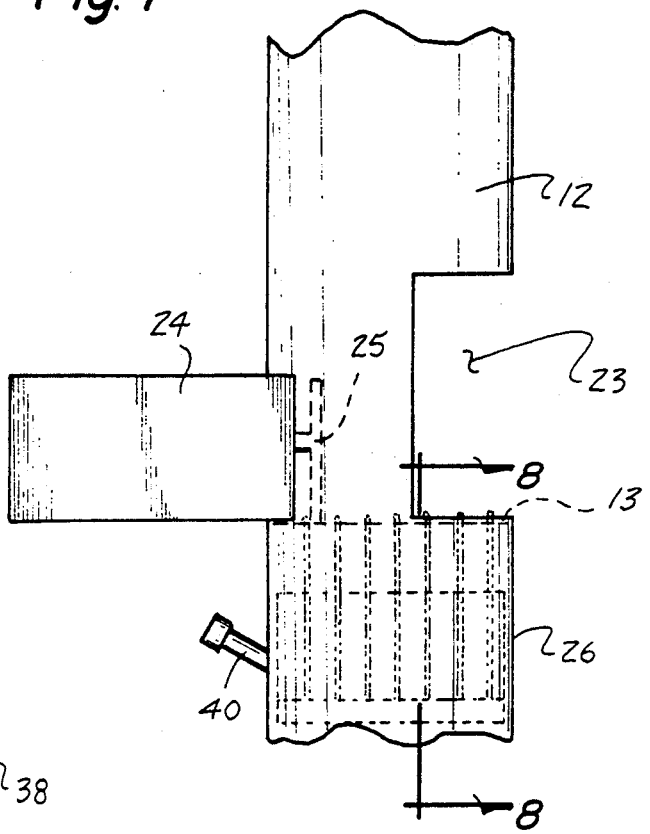
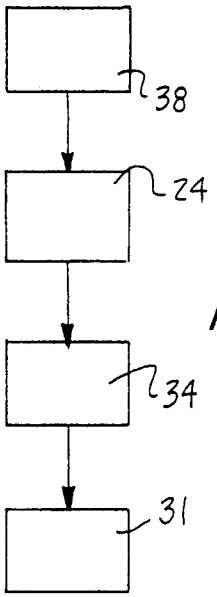
Fig. 9
Fig. 8
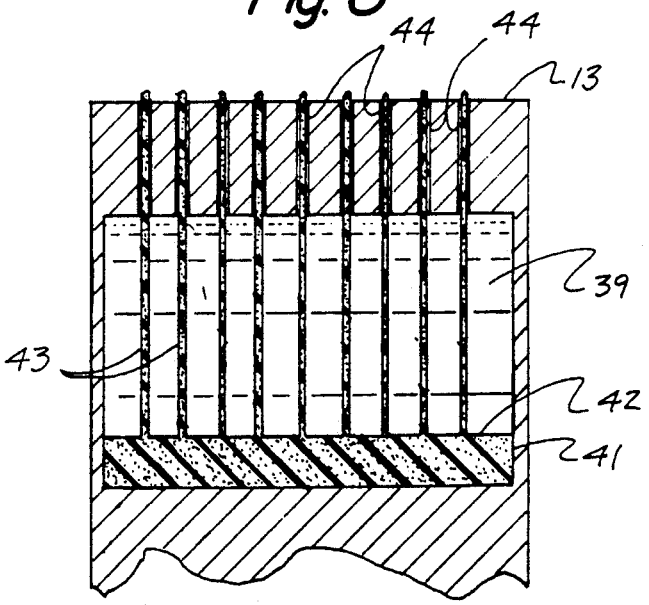

CAN CRUSHING APPARATUS

BACKGROUND OF THE INVENTION

1. Field of the Invention

The field of invention relates to can crushing structure, and more particularly pertains to a new and improved can crushing apparatus arranged to permit automated feed of beverage containers in a compact, readily stored relationship relative to an associated crushing structure.

2. Description of the Prior Art

Can crushing apparatus of various types have been utilized throughout the prior art and typically are of a manually operative type as indicated in U.S. Pat. No. 5,009,155.

Further manually operative can crushing structure is indicated in the U.S. Pat. No. 4,976,196 and 4,962,701.

The U.S. Pat. No. 4,235,164 indicates the use of a plurality of crushing platens for reciprocating movement from opposite ends of a chamber to effect crushing of a can member therebetween.

The instant invention attempts to overcome deficiencies of the prior art by providing for a vertically oriented can crushing structure including automated feed of can members relative to the crushing structure and in this respect, the present invention substantially fulfills this need.

SUMMARY OF THE INVENTION

In view of the foregoing disadvantages inherent in the known types of can crushing apparatus now present in the prior art, the present invention provides a can crushing apparatus wherein the same employs a feed hopper in operative communication with a guide tube to direct cans for crushing in operative communication with a crushing plate. As such, the general purpose of the present invention, which will be described subsequently in greater detail, is to provide a new and improved can crushing apparatus which has all the advantages of the prior art can crushing apparatus and none of the disadvantages.

To attain this, the present invention provides a cylindrical housing including a piston displaceable therewithin, wherein the piston includes a piston plate mounted to an opposed end of a piston rod, wherein the piston plate is in operative communication and directed through a guide tube having a tube floor to effect crushing of an associated can member directed between the piston plate and the guide tube floor. Feet structure is arranged to intersect the guide tube between the piston plate and the guide tube floor to properly position a can member to effect crushing thereof.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved can crushing apparatus which has all the advantages of the prior art can crushing apparatus and none of the disadvantages.

It is another object of the present invention to provide a new and improved can crushing apparatus which may be easily and efficiently manufactured and marketed.

It is a further object of the present invention to provide a new and improved can crushing apparatus which is of a durable and reliable construction.

An even further object of the present invention is to provide a new and improved can crushing apparatus which is susceptible of a low cost of manufacture with regard to both materials and labor, and which accordingly is then susceptible of low prices of sale to the consuming public, thereby making such can crushing apparatus economically available to the buying public.

Still yet another object of the present invention is to provide a new and improved can crushing apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an enlarged orthographic view of the guide tube employing a sanitizing structure relative to the guide tube floor.

FIG. 8 is an enlarged orthographic view, taken along the lines 8—8 of FIG. 7 in the direction indicated by the arrows.

FIG. 9 is a flow chart indicating the inter-communication of the use of a limit switch in operative communication with the solenoid members when the limit switch is actuated by the piston plate.

DESCRIPTION OF THE PREFERRED EMBODIMENT

Figure 1:
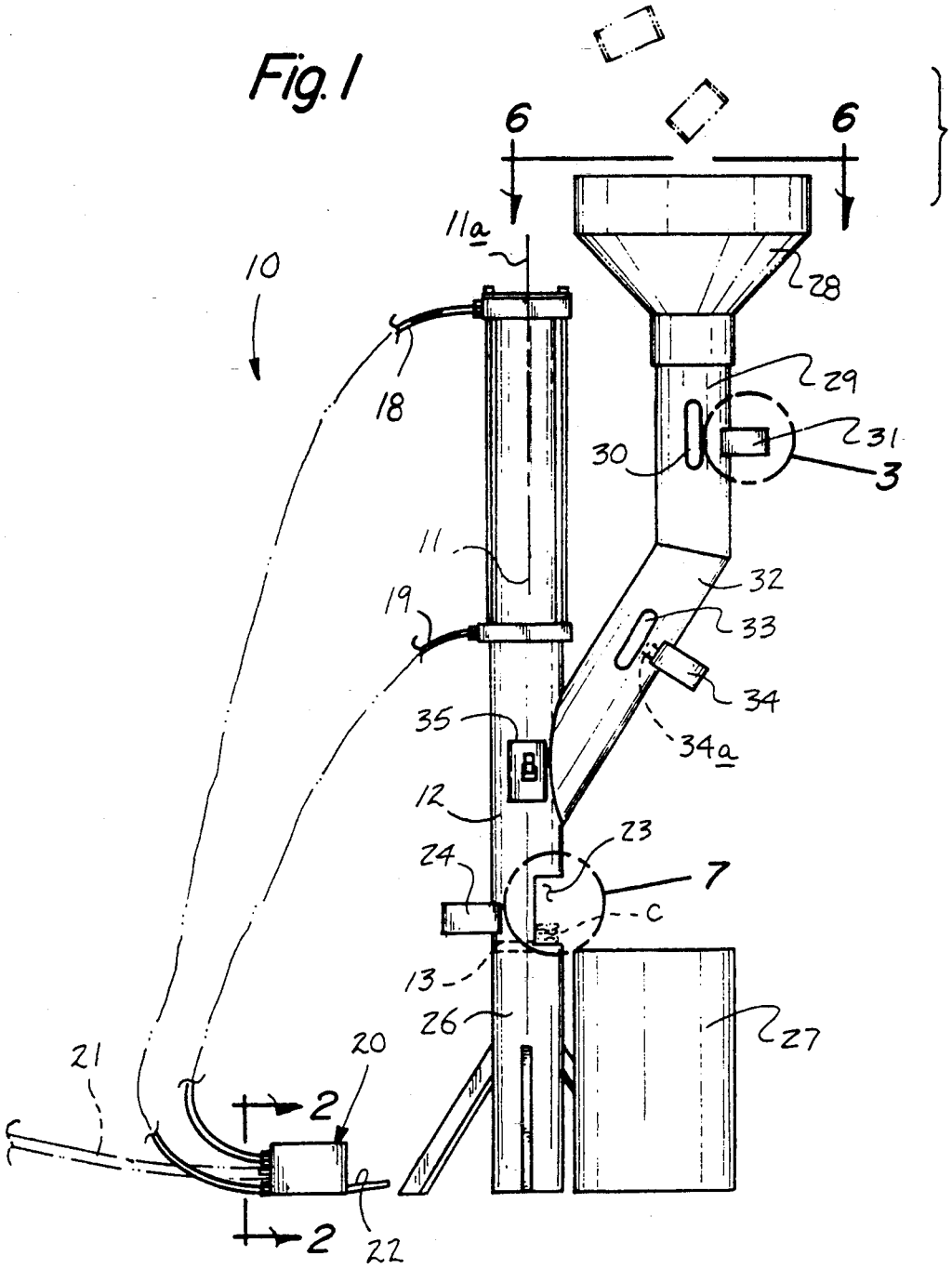
FIG. 1 is an orthographic view of the invention.
Figure 2:
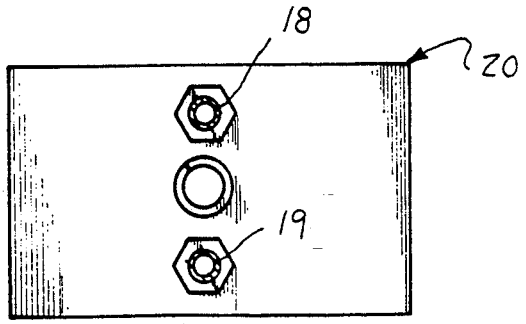
FIG. 2 is an orthographic view, taken along the lines 2—2 of FIG. 1 in the direction indicated by the arrows.
Figure 3:
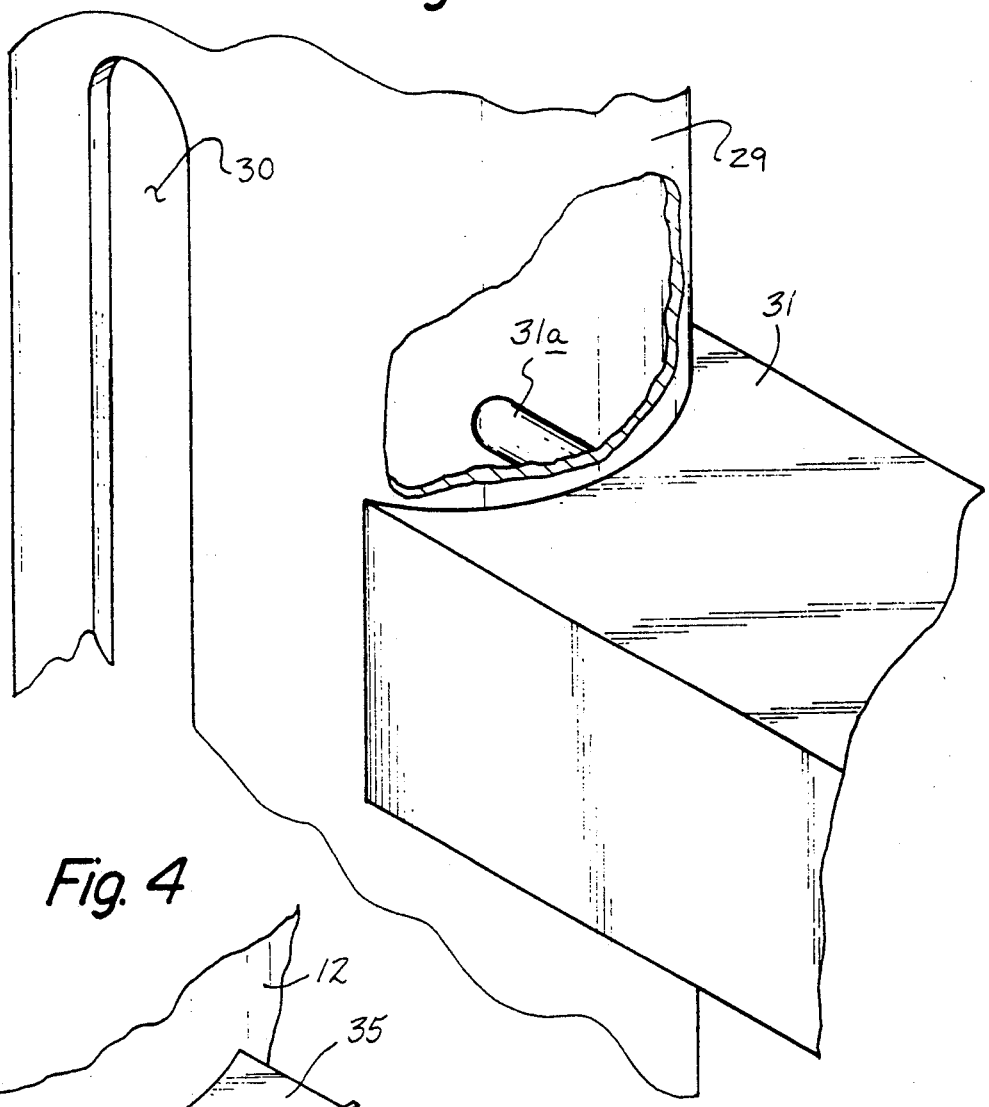
FIG. 3 is an isometric illustration of section 3 as set forth in FIG. 1.

With reference now to the drawings, and in particular to FIGS. 1 to 9 thereof, a new and improved can crushing apparatus embodying the principles and concepts of the present invention and generally designated by the reference numeral 10 will be described.

More specifically, the can crushing apparatus 10 of the instant invention essentially comprises a cylinder housing 11 in coaxial communication with a guide tube 12. The guide 12 includes a guide tube floor 13 spaced from the cylindrical housing 11 and orthogonally oriented relative to the cylindrical housing axis 11*a*. A piston 14 (see FIG. 5) is reciprocatably mounted within the cylinder housing 11. The piston 14 includes a piston rod 15, wherein the piston rod 15 has a piston plate 16 mounted slidably within the guide tube 12 spaced from the piston 14. The piston plate 16 is arranged for reciprocation within the guide tube and in communication with the guide tube floor 13 to crush a can member positioned thereon. The piston 14 is reciprocatably mounted within the pneumatic chamber 17 of the cylinder housing 11, wherein first and second pneumatic conduits 18 and 19 are directed into opposed upper and lowermost ends of the cylinder housing on opposed sides of the piston 14, with the first and second pneumatic conduits 18 and 19 in pneumatic communication with a primary pneumatic conduit 21 through a valve member 20 that is operative through a treadle plate 22 to permit selective pneumatic pressure directed to the first pneumatic conduit 18 upon depressing the treadle plate, whereupon release of the treadle plate redirects pneumatic pressure to the second conduit 19 to lift the piston 14 within the cylinder housing 11.

Figure 5:
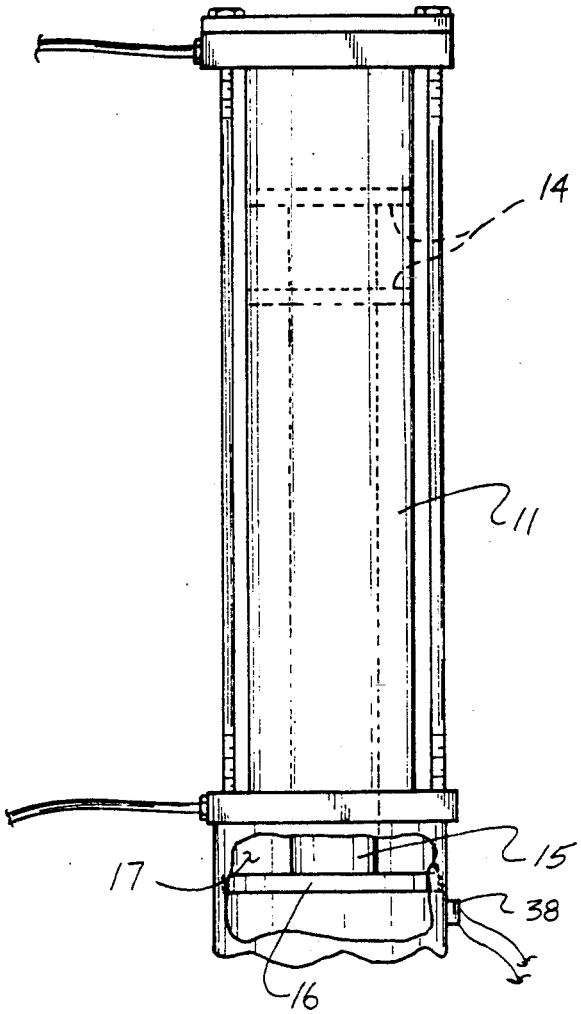
FIG. 5 is an enlarged orthographic view, partially in section, of the cylinder housing and associated piston structure.

An outlet opening 23 is directed through the guide tube 12 in adjacency to the guide tube floor 23, wherein a first solenoid 24 positioned on a diametrical side of the guide tube 12 relative to the guide tube outlet opening 23 permits actuation of the first solenoid 24 upon the piston 14 contacting a limit switch 38 (see FIG. 5) to effect ejecting of a can initially crushed by the piston plate 16, whereupon sequentially a third solenoid 34 releases a can member within the second feed tube 32 that is directed into the guide tube between the outlet opening 23 and the piston plate 16 in the raised or first position, as indicated in FIG. 5. The can thusly positioned within the second guide tube and visual observation thereof is available by a second indicator slot 33 directed into the second feed tube 22, the can is directed between the piston plate that accordingly directs the can onto the guide tube floor for a crushing procedure. Sequentially, a second solenoid 31 releases a can from a first feed tube 29, wherein such a can is visible through a first indicator slot 30 directed through the first feed tube 29, and the can thusly is directed from the first feed tube 29 into the second feed tube 32. In this manner, an orderly procession of cans is directed for a crushing procedure. Further, the first solenoid 24 is provided with a ram plate 25 (see FIG. 7 for example) that is positioned in a diametrically opposed orientation relative to the outlet opening 23 to project a can member crushed upon the guide tube floor 13. Further, a base housing 26 extends from the guide tube floor 13 to an underlying support, wherein a receptable container 27 is positioned below and in adjacency to the outlet opening 23 to accommodate a can thusly crushed. The can "C" is thusly crushed as indicated in phantom in FIG. 1.

Figure 4:
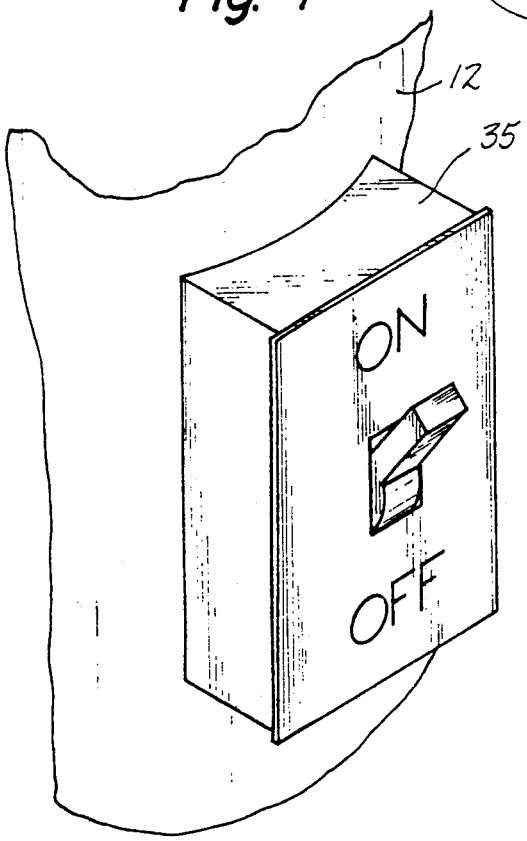
FIG. 4 is an enlarged isometric illustration of the switch structure mounted to the guide tube of the invention.

The FIG. 4 indicates the use of an on/off switch 35 conveniently mounted upon the guide tube 11 to provide electrical communication to the various solenoids and the limit switch 38.

The FIGS. 7 and 8 further indicate the use of an optional fluid reservoir 39 containing a bactericide and the like, wherein filling of the reservoir 39 is directed through a fill tube 40 directed through the guide tube in fluid communication with the fluid reservoir 39. The fluid reservoir includes a fluid reservoir floor 41 having a sponge member 42 positioned thereon, wherein the sponge member includes a plurality of sponge member fingers 43 projecting from the sponge member 42 through the fluid reservoir and the guide tube floor apertures 44 of the guide tube floor to thereby effect coating of a can member "C" crushed upon the guide tube floor 13.

Figure 6:
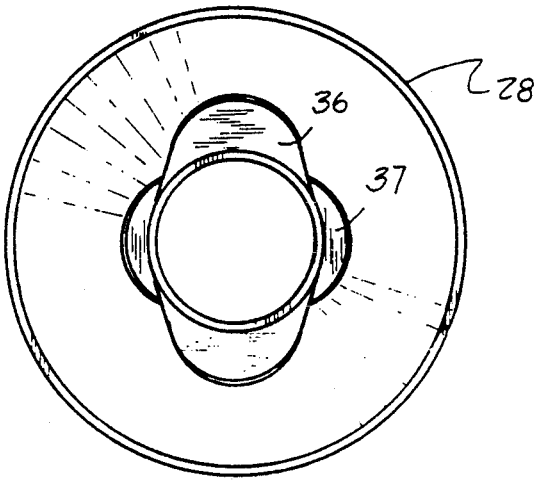
FIG. 6 is an orthographic view, taken along the lines 6—6 of FIG. 1 in the direction indicated by the arrows.

It should be further noted, as indicated in the FIG. 6, that at the entrance to the first feed tube, respective first and second ellipsoidal recesses 36 and 37 respectively whose major axes are orthogonally oriented relative to the first feed tube are thusly provided, wherein the recesses permit alignment of the can member directed into the hopper permitting ease of feed of such can member into the first feed tube.

It should be noted that the stepped feeding of can members to the first and second feed tubes 29 and 32 is effected by the respective second and third solenoids and respective second and third solenoid rams 31*a* and 34*a* projecting into the respective first and second feed tubes in a progressive manner to initially direct a can from the second feed tube into the guide tube 12 and thereafter upon return of the third solenoid ram 34*a* to the extended orientation within the second feed tube, the second solenoid ram 31*a* is retracted into the second solenoid to permit a can to fill between the second solenoid 31 and the third solenoid 34.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A can crushing apparatus, comprising, a cylinder housing and a guide tube housing arranged in end-to-end relationship relative to one another, with the cylinder housing in communication with the guide tube housing, and the cylinder housing and guide tube housing symmetrically oriented about a predetermined axis, and the guide tube housing including a guide tube floor orthogonally oriented relative to the predetermined axis and spaced from the cylinder housing, and a piston reciprocatably mounted within the cylinder housing, the piston including a piston rod directed through the cylinder housing and including a piston plate arranged parallel relative to the piston positioned within the guide tube housing arranged for reciprocation relative to the guide tube floor, and drive means arranged for reciprocation of the piston within the cylinder housing, and the guide tube housing including an outlet opening positioned in adjacency to the floor, and a first solenoid mounted through the guide tube housing spaced from the outlet opening, with the first solenoid including a ram plate orthogonally oriented relative to the guide tube floor arranged for projecting a workpiece from the guide tube floor through the outlet opening.

2. An apparatus as set forth in claim 1 wherein the guide tube housing includes a base housing extending from the guide tube housing, and a receptacle container positioned in adjacency to the base housing, wherein the receptacle container extends along the base housing in adjacency to and below the guide tube floor to accommodate the workpiece within the receptacle container.

3. An apparatus as set forth in claim 2 including a first feed tube arranged at an oblique angle relative to a second feed tube, wherein the first feed tube is in communication with the second feed tube, and the first feed tube includes a first feed tube first end having a hopper thereon, the hopper includes respective first and second ellipsoidal recesses in the hopper at the first feed tube first end, and the first feed tube including a first feed tube second end, and the second feed tube mounted to the first feed tube second end at a second feed tube first end, and the second feed tube including a second feed tube second end directed through the guide tube housing between the cylinder housing and the guide tube floor.

4. An apparatus as set forth in claim 3 wherein a limit switch is mounted through the guide tube housing in adjacency to the cylinder housing, and the limit switch is in operative communication with a second solenoid and a third solenoid, the second solenoid is directed through the first feed tube, with the second solenoid including a second solenoid ram arranged for selective projection within the first feed tube, and the third solenoid includes a third solenoid ram, and the third solenoid is directed into the second feed tube, with the third solenoid ram arranged for selective positioning to the second feed tube.

5. An apparatus as set forth in claim 4 including a fluid reservoir mounted within the base housing below the guide tube floor, and the fluid reservoir includes a fluid bactericide contained therewithin, and the fluid reservoir including a reservoir floor and a sponge member mounted on the reservoir floor, and the sponge member including a plurality of sponge member fingers projecting from the sponge member through the fluid reservoir, and wherein the guide tube floor includes a plurality of apertures, wherein each of the apertures receives one of said sponge member fingers therethrough to direct fluid from said fluid reservoir onto a workpiece projected upon the guide tube floor.

* * * * *